United States Patent [19]

Kohlstette

[11] Patent Number: 4,514,183

[45] Date of Patent: Apr. 30, 1985

[54] CENTRIFUGE WITH SELF-EMPTYING DRUM

[75] Inventor: Werner Kohlstette, Oelde, Fed. Rep. of Germany

[73] Assignee: Westfalia Separator AG, Oelde, Fed. Rep. of Germany

[21] Appl. No.: 471,419

[22] Filed: Mar. 2, 1983

[30] Foreign Application Priority Data

Mar. 11, 1982 [DE] Fed. Rep. of Germany ..... 3208808

[51] Int. Cl.[3] ..... B04B 11/02

[52] U.S. Cl. ..... 494/27; 494/40

[58] Field of Search ..... 494/23, 27, 29, 30, 494/56, 40

[56] References Cited

U.S. PATENT DOCUMENTS 3,189,267 6/1965 Thylefors ..... 494/27

3,550,843 12/1970 Hoffmann ..... 494/27

*Primary Examiner*—Robert W. Jenkins

*Attorney, Agent, or Firm*—Sprung, Horn, Kramer & Woods

[57] ABSTRACT

A centrifuge with a self-emptying drum is provided with expulsion openings in its jacket that lead from the solids space and that can be closed off by a piston slide. The piston slide is associated with a closure chamber, which can be supplied with a closure fluid and which has outlet channels around it that can be closed off by a valve body and that open into a blocking chamber. The blocking chamber can accommodate part of the closure fluid taken in by the closure chamber. The valve body and the piston slide are moved into the opening position for partial emptying. The valve body remains in the open position during partial emptying. The outlet channels are blocked by closure fluid taken in by the blocking chamber. This blocking fluid initiates the closing motion of the piston slide while closure fluid continues to be supplied to the closure chamber.

3 Claims, 1 Drawing Figure

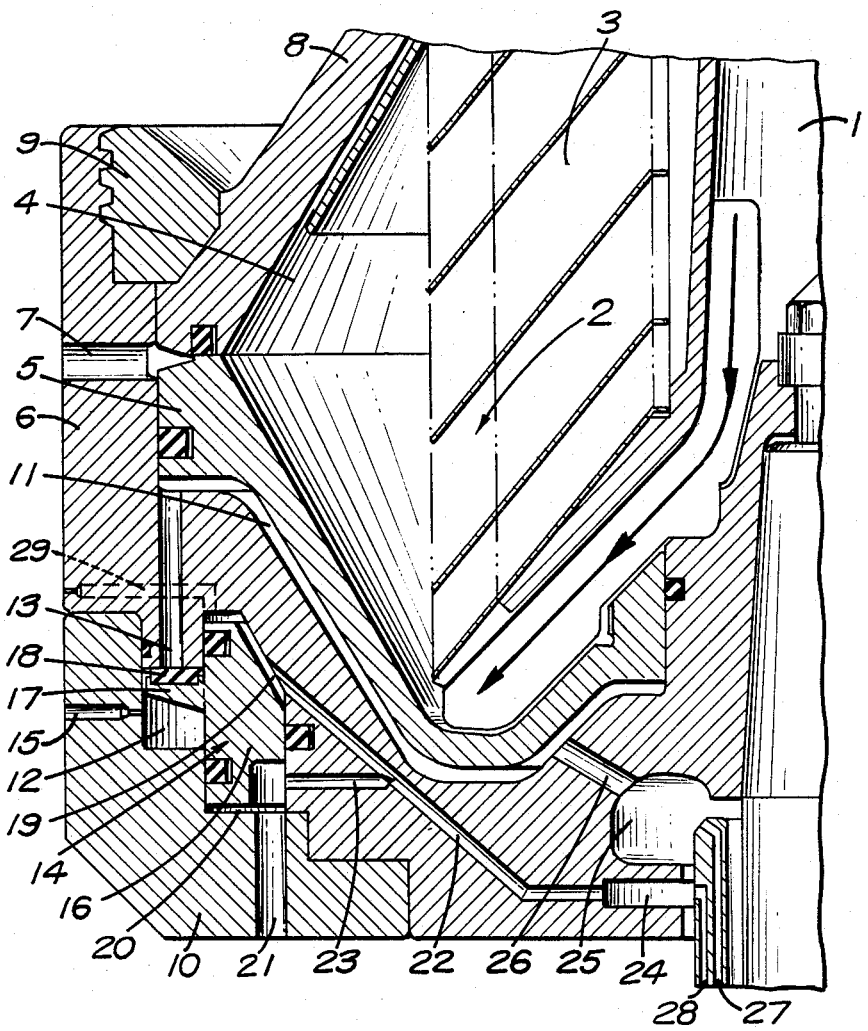
8
3
1
9
4
2
7
5
6
11
29
13
18
17
15
12
19
14
16
20
10
21
23
22
26
25
24
28
27

CENTRIFUGE WITH SELF-EMPTYING DRUM

BACKGROUND OF THE INVENTION

The present invention relates to a centrifuge with a self-emptying drum with expulsion openings in its jacket that lead from the solids space and that can be closed off by a piston slide associated with a closure chamber which can be supplied with a closure fluid and which has outlet channels around it that can be closed off by a hydraulically operated valve and through which the closure fluid can be supplied when the valve is open to a chamber with throttled outlet holes bored into it.

A centrifuge of this type, in which the valve body rests on springs that act in the closure direction and has a hydraulically active surface subjected to the closure fluid taken in by the chamber when the valve is open, is known from German Offenlegungsschrift No. 1 909 996. The closure fluid and the action of the springs in this centrifuge move the valve body into and maintain it in the closure position, initiating the closing motion of the piston slide. Since the pressure can not build up enough to close the piston slide in the closure chamber until the valve is closed and since it takes time for the valve body to close, the piston slide can not be made to stroke very high when the device is only partially emptied. When, on the other hand, the piston slide is only partly opened, it is impossible to optimally remove the solids because the slight overall expulsion-opening cross-section left free by the slide does not allrw the girdle of solids to break up.

SUMMARY OF THE INVENTION

The object of the present invention is to provide a centrifuge of the type initially described but in which the the piston slide closes more rapidly and strokes high enough to permit the solids to be broken up for optimal removal when the device is partially emptied.

This and other objects of the invention are achieved in accordance with the invention wherein the control chambers associated with the valve body are separated in a fluid-tight manner from the chamber that the outlet channels open into, the chamber can accommodate part of the closure fluid taken in by the closure chamber, the opening motion of the piston slide can be initiated for partial emptying by the opening motion of the valve body in a known manner, the valve body remains in the open position during partial emptying, the outlet channels can be blocked by closure fluid taken in by the chamber, this blocking fluid can be exploited, while closure fluid continues to be supplied to the closure chamber, to initiate the closing motion of the piston slide, and the piston slide is maintained in the closure position until the valve body assumes the closure position effected by control fluid and takes over the function of the blocking fluid. The closure fluid that is taken in by the chamber and that acts as a blocking fluid to block the outlet channels between the closure chamber and said chamber when the chamber is full is exploited in the centrifuge in accordance with the invention to initiate the closing motion of the piston slide. It is no longer necessary to bring the valve body into the closure position to initiate the closing motion of the piston valve. When the piston slide shifts from the opening to the closing motion, the inertia of the valve body and the controls associated with it will be bypassed.

BRIEF DESCRIPTION OF THE DRAWINGS

One embodiment of the invention will now be specified with reference to the drawing, wherein the figure is a partial vertical section through a centrifuge according to the invention.

DETAILED DESCRIPTION OF THE INVENTION

A mixture of solids and liquid is introduced through a centrally positioned inlet 1 into a centrifuging space 2 consisting of a separation space 3 and a solids space 4. One side of solids space 4 is bounded by a piston slide 5 that, as it moves along its axis, opens or closes solids-expulsion openings 7 in drum jacket 6.

The drum also has a cover 8 fastened by a lock ring 9 to jacket 6 and a guide ring 10 fastened to its bottom with screws (not shown).

Between piston slide 5 and the jacket or bottom of the drum is a closure chamber 11 that can be filled with closure fluid and that has outlet channels 13 around it that lead to a chamber 12 and that can be closed off by a hydraulically reversible valve body 14. Chamber 12 has throttled outlet holes 15 bored in it. Valve body 14 comprises an annular piston 16 from which cam-like extension arms 17 project into chamber 12. Each of the extension arms 17 bears a sealing plate 18 that can seal the bottom opening of an outlet channel 13 in a liquid-tight manner.

As is evident from the figure, the annular piston 16 of valve body 14 forms the whole inside wall of chamber 12. Control chambers 19 and 20, separated fluid-tightly from chamber 12, are associated with valve body 14. An overflow channel 21 opens into control chamber 20. Fluid is supplied to control chambers 19 and 20 through channels 22 and 23. Channels 22 end in a collecting gutter 24. Another collecting gutter 25 communicates through channels 26 with closure chamber 11.

Valve body 16 is moved into the closure position before inlet 1 is opened to introduce the mixture of solids and liquid to be separated. Closure chamber 11 is then charged with closure fluid through borings 27, collecting gutter 25, and channels 26, moving piston slide 5 into the closure position.

Once a specific amount of solids has collected in solids space 4, the centrifuge is partially emptied. Partial emptying is initiated by charging the control compartments 19 and 20 of valve body 14 with control fluid through borings 28, collecting gutter 24, and channels 22 and 23. Since the fluid pressure is essentially higher in control chamber 19 than in control chamber 20, valve body 14 will move into the opening position and the closure fluid will be centrifugally forced out of closure chamber 11 through outlet channels 13 into chamber 12 in fractions of a second. When chamber 12 is full, the closure fluid it takes in will act as a blocking fluid and block outlet channels 13, so that piston slide 5 will move back into the closure position as soon as the pressure in centrifuging space 2 has dropped, as a result of the amount of solids removed, to such an extent that the force generated in closure chamber 11 by the remaining closure fluid predominates. As closure fluid continues to be supplied, the fluid pressure in the closure chamber will very rapidly regain its maximum value and retain piston slide 5 in the closure position.

Since the inlet for the mixture of solids and liquid to be separated remains open during partial emptying, the pressure in separation space 3 and solids space 4, which has dropped during partial emptying, will rise again.

At the conclusion of partial emptying, the supply of control fluid through borings 28 and channels 22 to control chamber 19 is interrupted to reduce the fluid pressure in the chamber, from which the control fluid can flow off through throttled openings 29. Since the fluid pressure in control chamber 20 will now predominate, valve body 14 will now be moved into the closure position and take over the function of the blocking fluid.

It will be appreciated that the instant specification and claims are set forth by way of illustration and not limitation, and that various modifications and changes may be made without departing from the spirit and scope of the present invention.

What is claimed is:

1. In a centrifuge having a self-emptying drum with expulsion openings which are opened and closed by piston slide movable in response to pressure from closure fluid in a closure chamber having outlet channels therearound which are opened and closed by a valve body actuated by control fluid received in control chambers thereof, the expulsion openings and outlet channels being opened during emptying, the improvement comprising: first means forming a blocking chamber fluid-tightly separated from the control chambers and into which the outlet channels communicate when opened by the valve body, the blocking chamber having throttled outlets and configured to accommodate a part of the closure fluid from the closure chamber; and second means for supplying closure fluid to the closure chamber during emptying to effect a blocking of the outlet channels by the closure fluid in the blocking chamber to initiate a closing motion of the piston slide upon a reduction in pressure in the drum; whereby an opening motion of the valve body initiates an opening motion of the piston slide for partial opening with the valve body maintained in an open position during partial emptying and closed after the piston slide has reached a closing position.

2. The centrifuge according to claim 1, wherein the valve body comprises an annular piston forming the entire inside wall of the blocking chamber.

3. The centrifuge according to claim 2, the annular piston has cam-like extension arms and wherein each arm projects into the blocking chamber and bears a sealing plate for closing an outlet channel.

* * * * *